US008159149B2

(12) United States Patent
Mubaslat et al.

(10) Patent No.: US 8,159,149 B2
(45) Date of Patent: Apr. 17, 2012

(54) SYSTEMS AND METHODS FOR SECURITY CONTROLLED LED LIGHTING FIXTURE

(75) Inventors: Saed M. Mubaslat, Miamisburg, OH (US); Mark Poling, Springfield, OH (US); William Tyson, III, Urbana, OH (US)

(73) Assignee: Honeywell International Inc., Morristown, NJ (US)

( * ) Notice: Subject to any disclaimer, the term of this patent is extended or adjusted under 35 U.S.C. 154(b) by 721 days.

(21) Appl. No.: 12/258,136

(22) Filed: Oct. 24, 2008

(65) Prior Publication Data

US 2010/0103665 A1 Apr. 29, 2010

(51) Int. Cl.
*G05F 1/00* (2006.01)
*H05B 41/00* (2006.01)

(52) U.S. Cl. ..... 315/307; 315/312

(58) Field of Classification Search ..... 315/312, 315/185 R, 185 S, 291, 307, 7; 340/5.2, 340/5.21, 5.61, 7

See application file for complete search history.

(56) References Cited

U.S. PATENT DOCUMENTS

| | | | | |
|---|---|---|---|---|
| 5,748,106 | A * | 5/1998 | Schoenian et al. | 340/928 |
| 6,744,223 | B2 * | 6/2004 | Laflamme et al. | 315/291 |
| 7,193,502 | B2 * | 3/2007 | Vandrunen et al. | 340/5.71 |
| 7,253,566 | B2 | 8/2007 | Lys et al. | |
| 7,327,098 | B2 | 2/2008 | Chen | |
| 7,352,137 | B2 * | 4/2008 | Tabell | 315/291 |
| 7,358,929 | B2 | 4/2008 | Mueller et al. | |
| 7,391,159 | B2 * | 6/2008 | Harwood | 315/86 |
| 7,766,518 | B2 * | 8/2010 | Piepgras et al. | 362/373 |
| 7,804,256 | B2 * | 9/2010 | Melanson | 315/291 |
| 2006/0220571 | A1 * | 10/2006 | Howell et al. | 315/86 |
| 2007/0195552 | A1 | 8/2007 | Park | |
| 2008/0094005 | A1 | 4/2008 | Rabiner et al. | |

* cited by examiner

*Primary Examiner* — Douglas W Owens
*Assistant Examiner* — Minh D A
(74) *Attorney, Agent, or Firm* — Lowe Graham Jones PLLC

(57) ABSTRACT

A secure light emitting diodes (LEDs) power system controls power to a plurality of LEDs residing in a secure LED fixture coupled to a secure LED fixture mounting. An exemplary embodiment provides power to the plurality of LEDs and senses the power provided to the LEDs. In response to sensing the power, an authorization signal is communicated from a security sensor residing in the secure LED fixture. Power to the plurality of LEDs is maintained only in response to the communicated authorization signal.

16 Claims, 4 Drawing Sheets

SYSTEMS AND METHODS FOR SECURITY CONTROLLED LED LIGHTING FIXTURE

BACKGROUND OF THE INVENTION

Light emitting diode (LED) fixtures are configured to secure a plurality of light emitting LEDs. In some applications, the LEDs may emit non-visible electromagnetic energy, such as infrared light. Lens and reflectors in the LED fixture may be used to focus and/or direct the light emitted by the LEDs.

A controller controls operation of the LEDs. The LED controller may be controlled in a manner where the LEDs are operated in an "on" state, wherein light is emitted from the LEDs, or to an "off" state, wherein no light is emitted, by controlling the duty cycle of the power provided to the LEDs. In some applications, the color and/or intensity of the emitted light is controllable.

The LED fixture may be designed in a modular fashion such that the entire LED fixture may be readily installed into and/or removed from a fixture mounting. The fixture mounting may be attached to, or incorporated within, an application device. Non-limiting examples of the application device include aircraft, automobiles, and signs.

If one or more of the individual LEDs becomes inoperable such that the amount and/or nature of the emitted light does not satisfy the light emission requirements for a particular application, the LED fixture may be readily removed and replaced with a fully operational LED fixture. Replacing the entire LED fixture, rather than disassembling the LED fixture to replace individual LEDs, may save time and expense.

Coupling of the electrical connections of the LED light fixture to corresponding connections in the fixture mounting may be implemented with slidably engaging mating electrical connectors. Clamps, screws or other fasteners are typically used to affix the LED light fixture to its fixture mounting. Further, the shape of the LED fixture may match the shape of the fixture mounting so as to prevent the use of incompatible LED fixtures.

In some situations, the particular application may require precise control of the light emitted from the LED fixture. For example, if the LED fixture is installed in an aircraft, the direction, color, and/or intensity of the emitted light must satisfy predefined safety standards to ensure aircraft safety. However, if the LED lighting system is not secure against the use of noncompliant LED fixtures, it may be possible for a noncompliant LED fixture to be connected to the fixture mounting whereby an incorrect direction, color, and/or intensity of the emitted light may fail to satisfy the predefined safety standards. Accordingly, it is desirable to provide a secure LED lighting system that is operable only with a compliant LED fixture, and that is inoperable with a noncompliant LED fixture.

SUMMARY OF THE INVENTION

Systems and methods of powering a plurality of light emitting diodes (LEDs) residing in a secure LED fixture coupled to a secure LED fixture mounting are disclosed. An exemplary embodiment provides power to the plurality of LEDs and senses the power provided to the LEDs. In response to sensing the power, an authorization signal is communicated from a security sensor residing in the secure LED fixture. Power to the plurality of LEDs is maintained only in response to the communicated authorization signal.

In accordance with further aspects, an exemplary embodiment has a secure LED fixture with a plurality of LEDs, a secure LED fixture mounting configured to physically couple to the secure LED fixture, a LED driver and controller configured to electrically couple the plurality of LEDs to a power source, and a security sensor residing in the secure LED fixture. The security sensor senses power initially provided to the plurality of LEDs and communicates an authorization signal in response to sensing the power. Power is maintained to the plurality of LEDs only in response to communication of the authorization signal.

BRIEF DESCRIPTION OF THE DRAWINGS

Preferred and alternative embodiments are described in detail below with reference to the following drawings.

DETAILED DESCRIPTION OF THE PREFERRED EMBODIMENT

Figure 1:
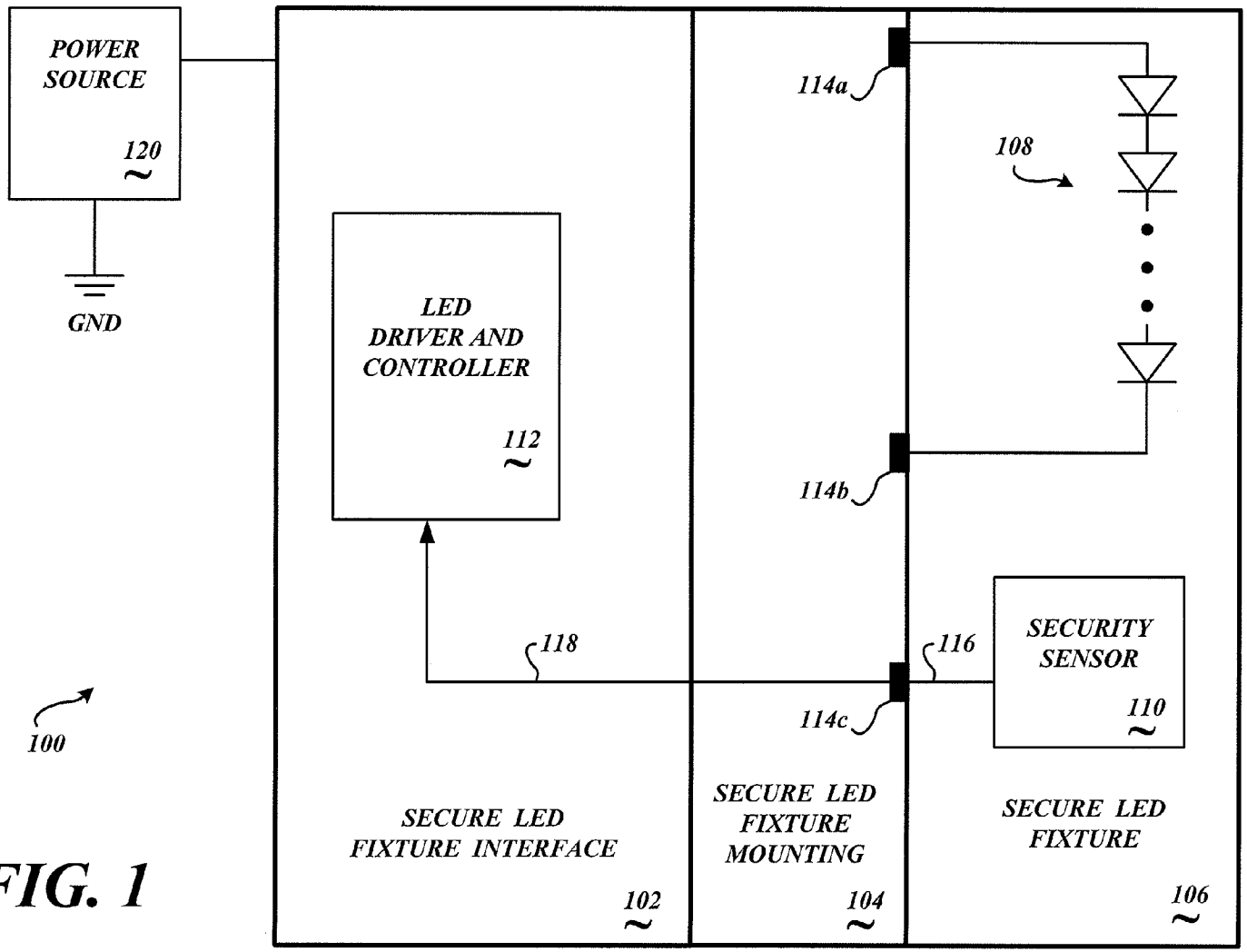
FIG. 1 is a block diagram of an embodiment of a secured light emitting diode (LED) system.

FIG. 1 is a block diagram of an embodiment of the secure light emitting diode (LED) system 100 that is secure against the use of noncompliant LED fixtures. An exemplary embodiment of the secure LED power system 100 includes a secure LED fixture interface 102, a secure LED fixture mounting 104, and a secure LED fixture 106 with a plurality of LEDs 108 therein. The secure LED power system 100 detects presence of a LED fixture coupled to the secure LED fixture mounting 104. The secure LED power system 100 provides power to the LEDs therein when the detected LED module is authenticated as a secure LED fixture 106.

A security sensor 110, residing in the secure LED fixture 106, detects initial operation of the plurality of LEDs 108. The security sensor 110 generates and communicates an authorization signal to a LED driver and controller 112 residing in the secure LED fixture interface 102. Upon receipt of the authorization signal, the LED driver and controller 112 continues to provide power from a power source 120 to the secure LED fixture mounting 104 for operation of the plurality of LEDs 108. In the absence of the authorization signal, the secure LED power system 100 does not provide power to the plurality of LEDs 108.

In the various embodiments, the LED driver and controller 112 controls power delivery (voltage and/or current) to the plurality of LEDs 108. Preferably, power is initially provided to the LED fixture in a controllable manner by the LED driver and controller 112. The security sensor 110 residing in a secure LED fixture 106 senses the initially delivered power, and then generates and communicates the authorization signal to the LED driver and controller 112 in response to sensing the initially delivered power. As noted above, the LED driver and controller 112 maintains power delivery to the plurality of LEDs 108 upon receipt of the authorization signal. However, if a noncompliant LED fixture has been coupled to the secure LED fixture mounting 104, the authorization signal will not be received by the LED driver and controller 112 (since the security sensor 110 will be absent from the noncompliant LED fixture). In some embodiments, the LED driver and controller 112 waits a predefined time period to receive the authorization signal before power delivery is discontinued.

The secure LED fixture 106 is configured to physically couple and electrically couple to the secure LED fixture mounting 104. Coupling of the electrical connections of secure LED fixture 106 to corresponding connections in the secure LED fixture mounting 104 may be implemented with slidably engaging mating electrical connectors 114 to facilitate convenient installation and/or removal of the secure LED fixture 106. For example, connectors 114*a* and 114*b* provide electrical power to the plurality of LEDs 108. Nonlimiting examples of slidably engaging mating electrical connectors 114 include, but are not limited to, pin connectors, spade connectors, and plug and socket connectors, and other suitable solderless connectors. Other embodiments may use any suitable connector, including locking connectors, block and terminal connectors, screw type connectors, solder connectors, or other suitable connectors, though such connectors may make replacement of the secure LED fixture 106 relatively more difficult.

Some embodiments use a hard wire connection to communicate the authorization signal. In one exemplary embodiment, the authorization signal is communicated over the connection 116 from the security sensor 110 to the connection 118 of the LED driver and controller 112. The connector 114*c* couples the connection 116 to the connection 118.

Clamps, screws or other fasteners are typically used to affix the LED light fixture to its fixture mounting. Further, the shape of the LED fixture may match the shape of the fixture mounting so as to limit the use of LED fixtures to a particular format.

It is appreciated that some level of fixture security may be designed into a LED system by selectively designing the shape of the LED fixture mounting and its corresponding LED fixture. Also, some security may be provided by selecting the type of electrical connectors and/or the location of the electrical connectors. Security may be provided by selecting the type and location of the fasteners that provide a compatible physical coupling of the LED fixture mounting with a LED fixture. For example, a round shaped LED fixture is not compatible with a square shaped LED fixture mounting. A pin type electrical connector may not properly couple to a spade type electrical connector.

However, such physically-based security features may be easily defeated by a noncompliant LED fixture. The maker of the noncompliant LED fixture need only match the shape of the noncompliant LED fixture to match the LED fixture mounting, and configure the type and locations of the electrical connectors and fasteners of the noncompliant LED fixture to match the electrical connectors and fasteners of the secure LED fixture mounting 104. Accordingly, in the absence of the security feature, the noncompliant LED fixture would otherwise be operable when coupled to the secure LED fixture mounting 104. Such situations may be undesirable, as noted above, when the direction, color, and/or intensity of the emitted light from the noncompliant LED fixture does not satisfy predefined safety standards. Accordingly, embodiments of the secure LED power system 100 ensure that a noncompliant LED fixture is not operable when coupled to the secure LED fixture mounting 104.

Figure 2:
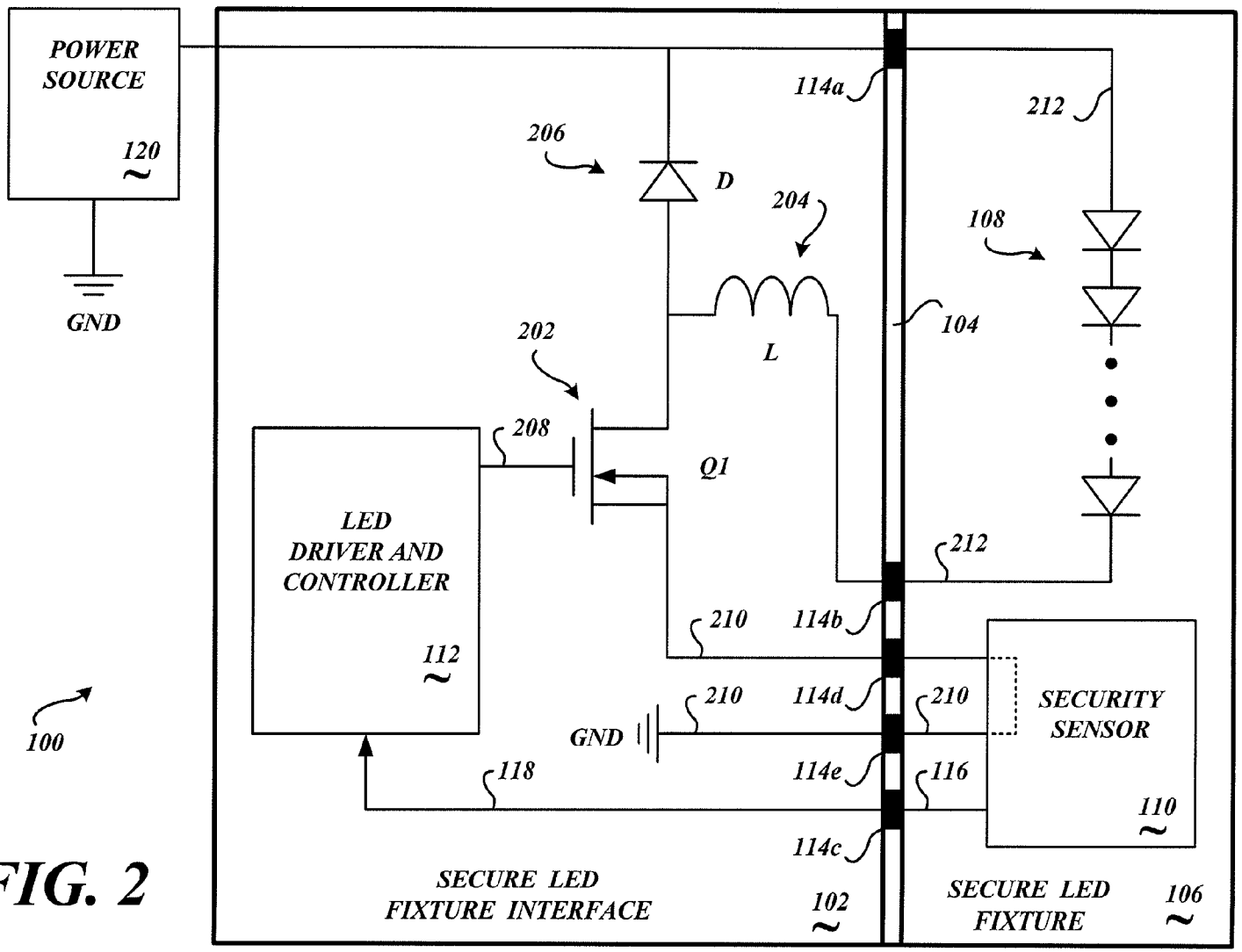
FIG. 2 is a block diagram of an embodiment of the secure LED system that interrupts power delivery to a noncompliant LED fixture by controlling actuation of a transistor.

FIG. 2 is a block diagram of an embodiment of the secure LED power system 100 that interrupts power delivery to the noncompliant LED fixture by controlling actuation of a transistor 202 (Q1). This exemplary embodiment includes an inductor 204 (L) and a diode 206 (D). The LED driver and controller 112 controls delivery of power to the plurality of LEDs 108 by selectively actuating the transistor 202 by providing a signal to the transistor 202, via a connection 208. For example, but not limited to, the LED driver and controller 112 may control the duty cycle of the pulse width modulation of the transistor 202 to control current delivered to the plurality of LEDs 108.

The security sensor 110 monitors a connection 210 to determine that power is being provided to the plurality of LEDs 108. In response to determining that power is being provided to the plurality of LEDs 108, the security sensor 110 generates and communicates the authorization signal to the LED driver and controller 112. In some embodiments, characteristics of the delivered power may be monitored such that the authorization signal is communicated when the supplied power characteristics are compatible with the plurality of LEDs 108.

If power is being provided to the plurality of LEDs 108 residing in the secure LED fixture 106, the LED driver and controller 112 receives the authorization signal and continues to provide power to the plurality of LEDs 108. On the other hand, if power is provided to the plurality of LEDs 108 residing in a noncompliant LED fixture, the LED driver and controller 112 does not receive the authorization signal. Accordingly, the LED driver and controller 112 actuates the transistor 202 to discontinue power delivery to the plurality of LEDs 108.

The authorization signal may be used by the LED driver and controller 112 for other purposes. For example, in the exemplary embodiment of FIG. 2, the LED driver and controller 112 may determine the duty cycle based upon the characteristics of the received authorization signal. When the authorization signal is used to determine the duty cycle, the LED driver and controller 112 may actuate the transistor 202 to control current delivered to the plurality of LEDs 108.

The security sensor 110 monitors voltage and/or current on connections 212 that provide power to the plurality of LEDs 108. Accordingly, the authorization signal is generated in response to power being delivered to the plurality of LEDs 108. In another embodiment, a light detector (not shown) detects light emitted by one or more of the plurality of LEDs 108, wherein the authorization signal is generated in response to the detection of emitted light.

Figure 3:
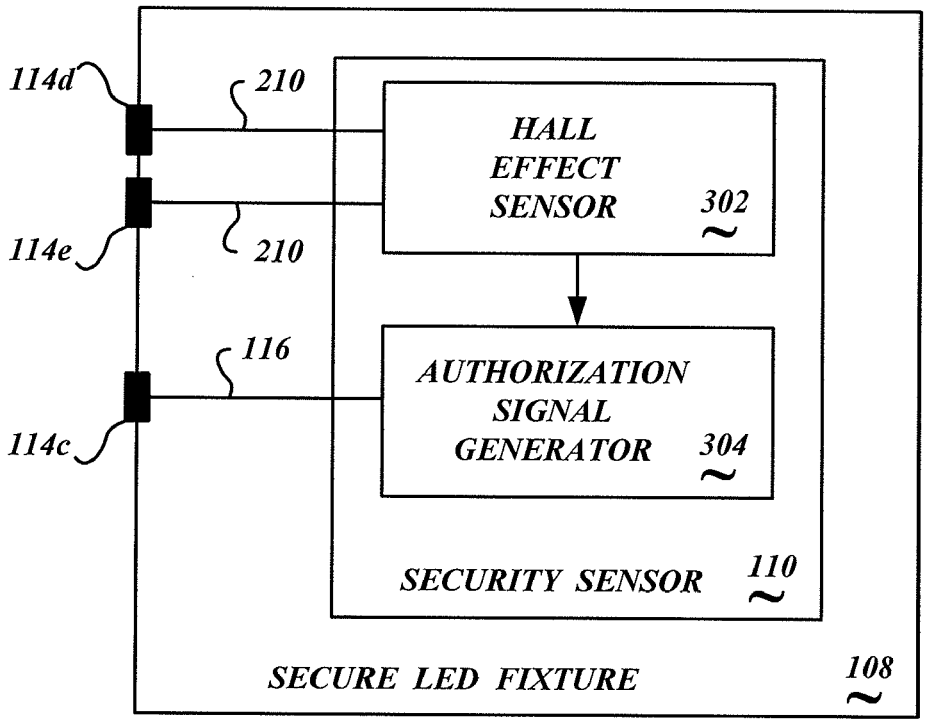
FIG. 3 is a block diagram of an exemplary security sensor that includes a Hall effect sensor.

FIG. 3 is a block diagram of an exemplary security sensor 110 that includes a Hall effect sensor 302. The Hall effect sensor 302 varies its output based upon detected changes in a magnetic field generated by current flowing in the connection 210. The exemplary security sensor 110 includes an optional authorization signal generator 304, coupled to the Hall effect sensor 302, that generates the authorization signal. The optional authorization signal generator 304 may be used to generate the authorization signal in a format that is receivable by the LED driver and controller 112. If the output of the Hall effect sensor 302 is in a format that is receivable by the LED driver and controller 112, the optional authorization signal generator 304 may be omitted. Further, the output of the Hall effect sensor 302 may be used by the LED driver and controller 112 for other purposes. For example, the LED driver and controller 112 may determine the duty cycle based upon the characteristics of the received output signal of the Hall effect sensor 302.

Figure 4:
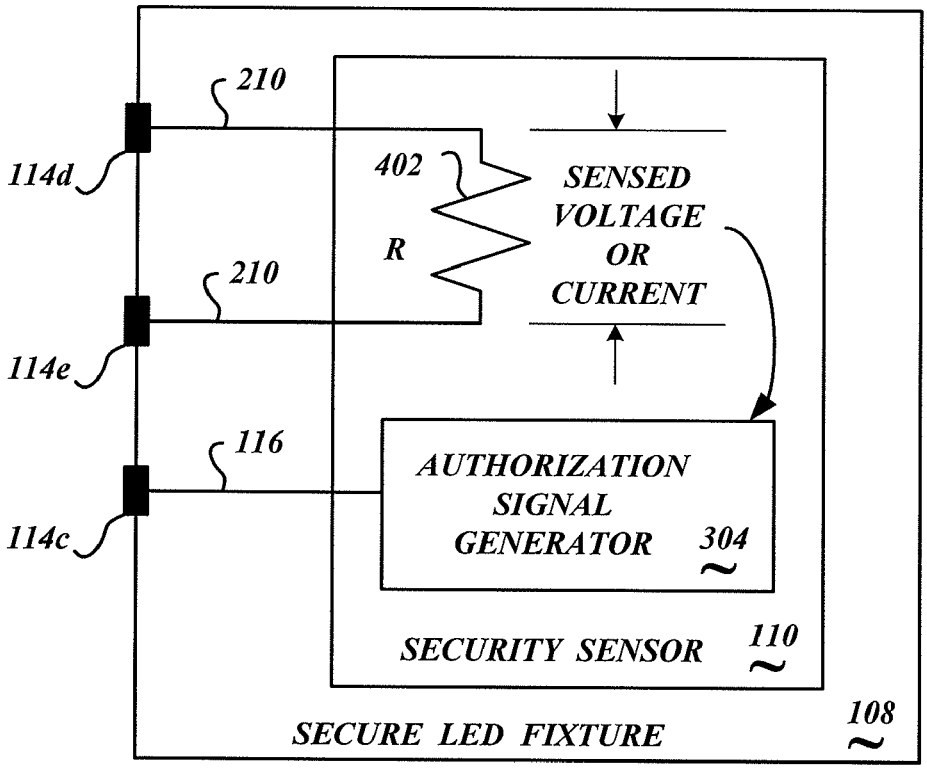
FIG. 4 is a block diagram of an exemplary security sensor that includes a resistor.

FIG. 4 is a block diagram of an exemplary security sensor 110 that includes a resistor 402 (R). A voltage across the resistor 402 will vary based upon detected changes in current flowing in the connection 210. The exemplary security sensor 110 includes an optional authorization signal generator 304, coupled to the resistor 402, that generates the authorization signal. The optional authorization signal generator 304 may be used to generate the authorization signal in a format that is receivable by the LED driver and controller 112. If the voltage output across the resistor 402 is in a format that is receivable by the LED driver and controller 112, the optional authorization signal generator 304 may be omitted. Further, the voltage output across the resistor 402 may be used by the LED driver and controller 112 for other purposes. For example, the LED driver and controller 112 may determine the duty cycle based upon the characteristics of the received voltage output across the resistor 402.

Figure 5:
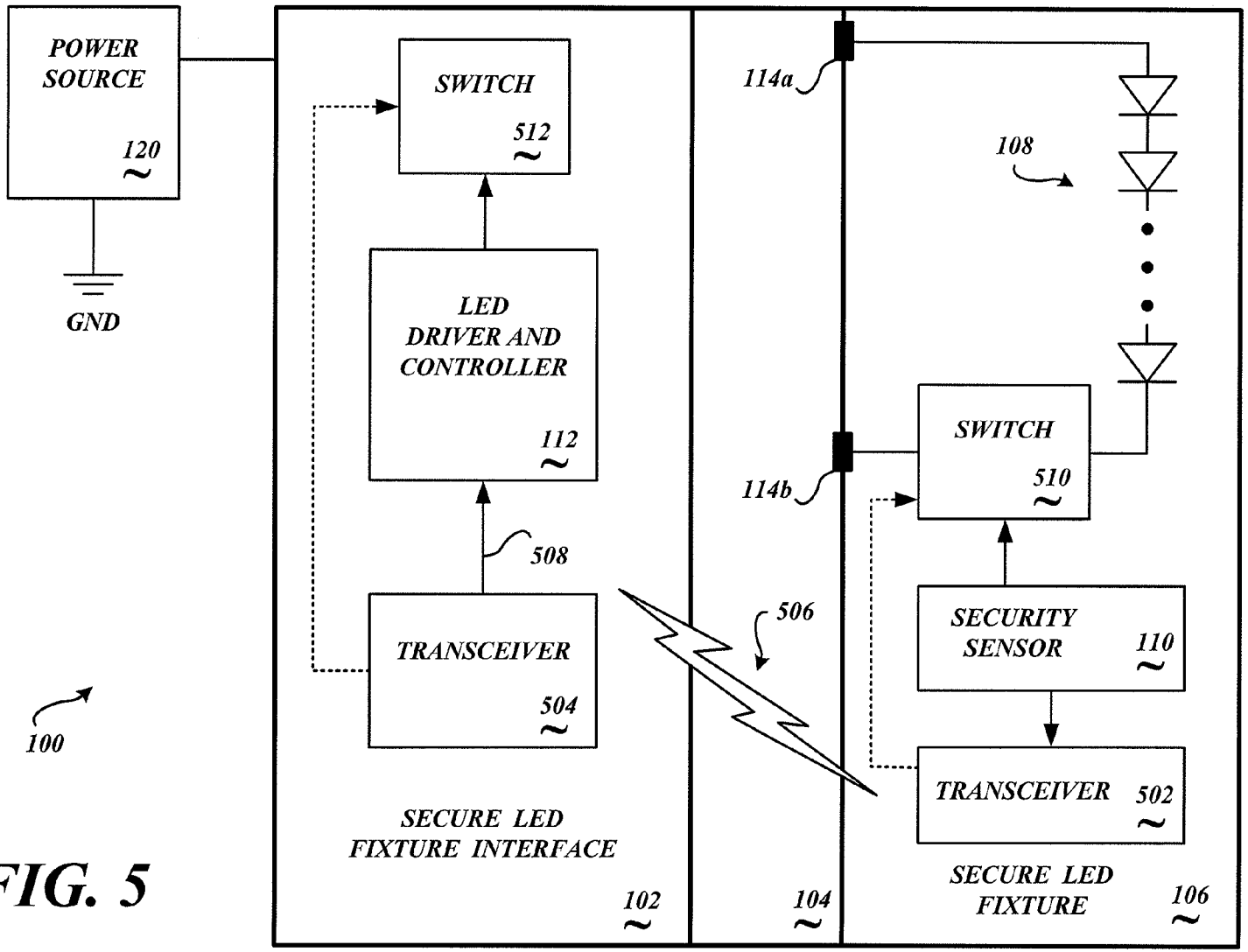
FIG. 5 is a block diagram of an exemplary security sensor that includes transceivers that communicate the authorization signal in a wireless format.

FIG. 5 is a block diagram of an exemplary security sensor 110 that includes a first transceiver 502 and a second transceiver 504 that communicate the authorization signal 506 in a wireless format. The wireless authorization signal 506 may be a radio frequency (RF) signal, an infrared (IR) signal, an optical signal, or other suitable wireless signal.

In an exemplary embodiment, the transceiver 502 is operable as a transmitter. The transceiver 502 transmits the authorization signal to the transceiver 504, which is operating as a receiver. (Alternatively, the transceiver 502 may be a transmitter and/or the transceiver 504 may be a receiver, which are interchangeably referred to herein as a "transceiver" for convenience.) The transceiver 504 then reformats the received wireless authorization signal 506 into a format that is receivable by the LED driver and controller 112, and communicates the authorization signal to the LED driver and controller 112, via a hardwire connection 508.

In some embodiments, the authorization signal is formatted as a binary signal with a unique identifier that identifies the secure LED fixture 106. A plurality of different models of secure LED fixtures 106 may vary based upon the number and/or type of LEDs 108 therein, or may vary based upon other characteristics, such as a particular lens and/or reflector. For example, more LEDs 108 may be used in models that are designed to emit a higher intensity light. Different models may have LEDs that emit different colors, or emit visible and/or infrared light. Different models may have different reflectors and/or lens that condition the emitted light in different ways. Such models may have substantially the same fixture structure or form, may have substantially the same type of electrical connectors and/or the location of the electrical connectors, and/or may have substantially the same type and location of the fasteners, to provide a compatible physical coupling to a secure LED fixture mounting 104. Depending upon the particular application, the intended purpose of the light emitted from the secure LED fixture 106 may be different. Thus, different models of the secure LED fixture 106 may have different intended light emission characteristics.

Accordingly, it would be undesirable to allow operation of a model of the secure LED fixture mounting 104 that does not emit light that satisfies an intended purpose. Thus, in some embodiments, a unique identifier may be part of the authorization signal such that the LED driver and controller 112 may discriminate between different models of secure LED fixtures 106. If the particular application requires a particular model of a secure LED fixture 106, then the LED driver and controller 112 may determine if the correct model of the secure LED fixture 106 has been coupled to its respective secure LED fixture mounting 104.

When the correct model of the secure LED fixture 106 has been coupled to the secure LED fixture mounting 104, the LED driver and controller 112 supplies power to the plurality of LEDs 108. In some embodiments, the LED driver and controller 112 may generate and communicate an acknowledgement signal indicating that a compliant secure LED fixture 106 has been coupled to the secure LED fixture mounting 104. For example, the transceiver 504 may be operable to communicate a wireless acknowledgement signal to the transceiver 502. In embodiments that use physical wires, the acknowledgement signal may be communicated via connectors 118, 116 (FIGS. 1 and 2).

The acknowledgement signal may be used to confirm that a compliant model of the secure LED fixture 106 has been coupled to the secure LED fixture mounting 104. A suitable indication may then be provided based upon the acknowledgement signal. For example, an indicator light or the like may be actuated in response to the acknowledgement signal to indicate that a compliant model of the secure LED fixture 106 has been coupled to the secure LED fixture mounting 104. Absence of the acknowledgement signal (when the acknowledgement signal is expected), or receipt of an acknowledgement signal that indicates presence of a noncompliant LED fixture, may also be used to indicate that the noncompliant LED fixture has been coupled to the secure LED fixture mounting 104. For example, a green light indicator may indicate that a compliant secure LED fixture 106 has been coupled to the secure LED fixture mounting 104, and a red light indicator may indicate that a noncompliant LED fixture has been coupled to the secure LED fixture mounting 104.

A switch 510 (FIG. 5) may be included in the secure LED fixture 106 to interrupt power flow through the plurality of LEDs 108 if the acknowledgement signal indicates that a noncompliant model of the secure LED fixture 106 has been coupled to the secure LED fixture mounting 104. The switch 510 is electrically coupled to the plurality of LEDs 108. Further, the switch 510 is communicatively coupled to the security sensor 110 and is configured to interrupt the power if no authorization signal is received from the security sensor. In other embodiments, the switch 510 is communicatively coupled to the transceiver 502 and is configured to interrupt the power if no acknowledgement signal is received.

A switch 512 residing in the secure LED fixture interface 102 may be operable to interrupt the power flow to the plurality of LEDs 108. In some embodiments, the switch 512 may be communicatively coupled to and actuated by the transceiver 504. Alternatively, the switch 512 may be communicatively coupled to and actuated by the LED driver and controller 112. In some embodiments, the switch 512 may be integrated into the LED driver and controller 112. In other embodiments, the switch 512 may be controlled directly by the authorization signal, such as when the switch 512 is coupled to the connection 118 (FIGS. 1 and 2). The switch 512 may reside in any suitable location. As another nonlimiting example, the switch 512 may be a component of the power source 120, or may be coupled to an output of the power source 120.

In alternative embodiments, one or more components of the secure LED fixture interface 102 may be relocated into the secure LED fixture 106. Thus, if a critical component necessary of operation of the plurality of LEDs 108 is missing from the LED fixture, a noncompliant LED fixture will not be operable with embodiments of the secure LED power system 100. The relocated critical component may be used by a security sensor 110 to generate the authorization signal and/or respond to an acknowledgement signal.

Other embodiments may have the components of the secure LED fixture interface 102 configured in a different manner. Alternatively, or additionally, other components within the secure LED fixture interface 102 may be used to control the plurality of LEDs 108 in the secure LED fixture 106. In some embodiments, discrete groups of different pluralities of LEDs 108 may be separately operated, or operated in combination, such that light having specified characteristics is emitted from the secure LED fixture 106. Further, any suitable type of LED driver and controller 112 may be used to control the plurality of LEDs 108.

Embodiments of the secure LED power system 100, in the absence of the authorization signal, may discontinue power to a noncompliant LED fixture in any suitable manner using any suitable means. For example, the authorization signal may be communicated to the power source 120. In another embodiment, the LED driver and controller 112 may generate and communicate a signal to the power source 120 to cause the power source 120 to interrupt power delivery to the noncompliant LED fixture.

The exemplary embodiment of the secure LED power system 100 illustrates a combination of components (the transistor 202, the inductor 204, and the diode 206) residing in the secure LED fixture interface 102 that are configured to supply power to the plurality of LEDs 108. The components may be arranged in alternative configurations in other embodiments. Some components may be omitted, and/or other components not illustrated may be added in alternative embodiments. In other embodiments, one or more of the illustrated components may be located external to the secure LED fixture interface 102 as separate components and/or may be integrated into other systems or devices.

The secure LED fixture mounting 104 was described as a separate component to facilitate physical coupling of the secure LED fixture 106 to an application device. Non-limiting examples of the application device include aircraft, automobiles, and signs. Accordingly, the secure LED fixture interface 102 may reside elsewhere in the application device. Alternatively, the secure LED fixture mounting 104 and the secure LED fixture interface 102 may be implemented as a single integrated unit.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A method for operating a plurality of light emitting diodes (LEDs) residing in a secure LED fixture that is configured to detachably couple to a secure LED fixture mounting, the method comprising:

coupling a secure LED fixture to a secure LED fixture mounting, the secure LED fixture comprising the plurality of LEDs, a connector to a power source, and a security sensor;

providing power to the plurality of LEDs, the power provided via the connector, and the power provided by a power source external to the secure LED fixture;

sensing on the connector the power provided to the plurality of LEDs, wherein the sensing is performed by the security sensor residing in the secure LED fixture, the security sensor comprises a resistor, and wherein sensing the power comprises: sensing a change in a voltage of the resistor;

in response to sensing the power on the connector, communicating an authorization signal from the security sensor residing in the secure LED fixture to a LED driver and controller that is external to the secure LED fixture when the sensed voltage change of the resistor corresponds to powering the plurality of LEDs; and maintaining power to the plurality of LEDs only in response to communicating the authorization signal.

2. The method of claim 1, wherein the LED driver and controller provides the power to the plurality of LEDs, and further comprising:

receiving the communicated authorization signal by the LED driver and controller, wherein the LED driver and controller maintains the power to the plurality of LEDs only in response to communicating the authorization signal.

3. The method of claim 1, further comprising:

interrupting the power to the plurality of LEDs when the authorization signal is not received.

4. The method of claim 3, wherein the LED driver and controller interrupts the power to the plurality of LEDs when the authorization signal is not received within a predefined period of time.

5. The method of claim 1, further comprising:

controlling a duty cycle of the power provided to the plurality of LEDs based upon the received authorization signal.

6. The method of claim 1, wherein communicating the authorization signal from the security sensor comprises:

communicating the authorization signal over a wire.

7. The method of claim 1, wherein communicating the authorization signal from the security sensor comprises:

communicating the authorization signal wirelessly.

8. A secure light emitting diodes (LEDs) power system comprising:

a secure LED fixture comprising:

a plurality of LEDs;

a first connector configured to receive power from a power source to power the LEDs residing in the secure LED fixture;

a security sensor, wherein the security sensor comprising a resistor coupled in series with the plurality of LEDs senses power initially provided to the plurality of LEDs on the first connector be sensing a change in a voltage of the resistor, and wherein the security sensor is configured to communicate an authorization signal in response to sensing the voltage change of the resistor that corresponds to the power on the first connector that initially powers the plurality of LEDs;

a secure LED fixture mounting, comprising:

a second connector configured to physically couple with the first connector of the secure LED fixture, and configured to provide power to the first connector to the plurality of LEDs of the secure LED fixture;

a LED driver and controller external to the secure LED fixture, configured to receive the authorization signal from the security sensor of the secure LED fixture, and configured to interrupt or maintain the power provided to the plurality of LEDs of the secure LED fixture; and wherein power is maintained to the plurality of LEDs only in response to communication of the authorization signal from the security sensor in the secure LED fixture to the LED driver and controller.

9. The LED power system of claim 8, wherein the LED driver and controller receives the authorization signal, and wherein a duty cycle of the power provided to the plurality of LEDs is controlled by the LED driver and controller based upon the received authorization signal.

10. The LED power system of claim 8, further comprising:

a first transceiver communicatively coupled to the security sensor and configured to wirelessly communicate the authorization signal; and a second transceiver communicatively coupled to the LED driver and controller and configured to receive the wirelessly communicated authorization signal.

11. The LED power system of claim 10, wherein the secure LED fixture further comprises:

a switch communicatively coupled to the second transceiver, wherein the switch interrupts power to the plurality of LEDs when the authorization signal is not received.

12. The LED power system of claim 8, wherein the secure LED fixture mounting further comprises:

a switch communicatively coupled to the LED driver and controller, wherein the switch interrupts power to the plurality of LEDs when the authorization signal is not received.

13. The LED power system of claim 8, wherein the secure LED fixture further comprises:

a switch residing in the secure LED fixture, wherein the switch is communicatively coupled to the security sensor and is electrically coupled to the plurality of LEDs, wherein the switch interrupts power to the plurality of LEDs when the authorization signal is not received.

14. The LED power system of claim 8, further comprising:

a wire connection coupled to the security sensor and the LED driver and controller, wherein the authorization signal is communicated over the wire connection to the LED driver and controller.

15. The LED power system of claim 8, wherein the security sensor residing in the secure LED fixture is a component of the LED driver and controller, and wherein the component comprises at least one selected from a group consisting of a resistor, a transistor, an inductor, and a diode.

16. A LED power system for operating a plurality of light emitting diodes (LEDs) residing in a secure LED fixture coupled to a secure LED fixture mounting, the method comprising:

a means for providing power to the plurality of LEDs;

a means for sensing the power provided to the LEDs residing in the secure LED fixture, wherein the means for sensing senses a change in a voltage of a resistor residing in the secure LED fixture;

a first transceiver means for wirelessly communicating an authorization signal in response to sensing the voltage change when the power is provided to the plurality of LEDs, the first transceiver means residing in the secure LED fixture and communicatively coupled to the sensor means the first transceiver means wirelessly communicates the authorization signal to the second transceiver means;

a second transceiver means for receiving the wirelessly communicated authorization signal communicated from the first transceiver means; and a means for controlling a duty cycle of the power provided to the plurality of LEDs, the means for controlling communicatively coupled to the second transceiver means, wherein the duty cycle is controlled to power the plurality of LEDs based upon the received authorization signal.

* * * * *

UNITED STATES PATENT AND TRADEMARK OFFICE

CERTIFICATE OF CORRECTION

PATENT NO. : 8,159,149 B2
APPLICATION NO. : 12/258136
DATED : April 17, 2012
INVENTOR(S) : Saed M. Mubaslat, Mark Poling and William Tyson, III It is certified that error appears in the above-identified patent and that said Letters Patent is hereby corrected as shown below:

In Column 8, Line 35, after the word "sensor" please delete the phrase "wherein the security sensor"

In Column 8, Line 37, after the word "LEDs" please insert the phrase --, wherein the security sensor--

Signed and Sealed this
Fifteenth Day of January, 2013

David J. Kappos

David J. Kappos
*Director of the United States Patent and Trademark Office*